US007246391B2

(12) United States Patent
Brown

(10) Patent No.: US 7,246,391 B2
(45) Date of Patent: Jul. 24, 2007

(54) PRAYER PILLOW

(76) Inventor: Leslie M. Brown, 19997 Stoepel, Detroit, MI (US) 48221

( * ) Notice: Subject to any disclaimer, the term of this patent is extended or adjusted under 35 U.S.C. 154(b) by 0 days.

(21) Appl. No.: 11/405,954

(22) Filed: Apr. 17, 2006

(65) Prior Publication Data

US 2006/0230538 A1 Oct. 19, 2006

Related U.S. Application Data

(60) Provisional application No. 60/672,368, filed on Apr. 15, 2005.

(51) Int. Cl.
*A47C 16/04* (2006.01)

(52) U.S. Cl. ..... 5/648; 5/656; 182/230

(58) Field of Classification Search ..... 297/187, 297/423.11, 423.15, 423.16, 423.41; 5/648, 5/656; 128/882; 182/230; 2/24
See application file for complete search history.

(56) References Cited

U.S. PATENT DOCUMENTS

| | | | | |
|---|---|---|---|---|
| 1,690,405 | A * | 11/1928 | Du Rocher | 2/24 |
| 2,448,427 | A * | 8/1948 | Gordon | 280/32.5 |
| 3,499,502 | A * | 3/1970 | Rosander | 182/230 |
| 4,798,264 | A * | 1/1989 | Miller et al. | 182/230 |
| 6,810,541 | B1 * | 11/2004 | Woods | 5/420 |
| 6,883,177 | B1 * | 4/2005 | Ouellette et al. | 2/24 |
| 6,951,035 | B2 * | 10/2005 | Kinchen et al. | 5/420 |
| 2003/0019007 | A1 * | 1/2003 | Spencer | 2/24 |

* cited by examiner

*Primary Examiner*—Michael Trettel
(74) *Attorney, Agent, or Firm*—Rohm & Monsanto, PLC

(57) ABSTRACT

A prayer pillow, or cushion, has knee pads placed in the interior of the pillow filling, spaced apart and adapted to receive the knees of a user while kneeling. The knee pads provide further cushioning and support for the knees of the user so that kneeling for a protracted time is more comfortable. The pillow has a removable cover that may, in preferred embodiments, incorporate a pleasant design and verses of Biblical scripture. The spacing between the knee pads maybe adjusted by the user.

15 Claims, 2 Drawing Sheets

PRAYER PILLOW

RELATIONSHIP TO OTHER APPLICATION

This application claims the benefit of U.S. Provisional Application Ser. No. 60/672/368 filed on Apr. 15, 2005. The disclosure of that provisional patent application is incorporated herein by reference.

BACKGROUND OF THE INVENTION

1. Field of the Invention

This invention relates generally to pillow or cushion for kneeling, and more particularly, to a pillow or cushion having knee pads for supporting the knees of a user while in a kneeling position 2. Description of the Related Art There are many people who pray in a kneeling position. This position can be uncomfortable if done over a protracted period of time, interfering with the comfort and concentration of the worshiper. It is known that kneeling on a pad or cushion will alleviate some of the discomfort.

It is, however, an object of this invention to provide a cushion, or pillow, that provides additional support and cushioning effect to the knees of the user to make the worshiping experience more pleasant.

SUMMARY OF THE INVENTION

The foregoing and other objects are achieved by this invention which provides, in accordance with a first apparatus aspect of the invention, a kneeling cushion for a human user, the kneeling cushion having a cushion substrate formed of a resilient cushion material having a first resilience characteristic. First and second spaced-apart knee-receiving elements are formed of a knee pad material having a second resilience characteristic that preferably is firmer than the first resilience characteristic. Additionally, a cushion cover is arranged to overlie the cushion substrate and the first and second spaced-apart knee-receiving elements.

In one embodiment of the invention, the resilient cushion material is a filling material. The filling material may be a cotton batting, or a polyester batting.

In a further embodiment, the filling material is configured to have spaced-apart depressions that accommodate the first and second spaced-apart knee-receiving elements. Preferably, the first and second spaced-apart knee-receiving elements are configured to have respective cup-like openings for accommodating the respective bended knees of the human user. In a further embodiment, the cup-like openings each have an associated upward extending member for providing lateral support to the respective bended knees of the human user. In some embodiments, the cup-like openings each have associated foam or gel inserts therein.

In an advantageous embodiment, the first and second spaced-apart knee-receiving elements are disposed at a distance from one another that is adjustable in response to forces applied by the human user. More specifically, the human user can apply laterally outward or inward forces, illustratively using the knees, to adjust the spacing between the knee-receiving elements to the comfort of the user.

A limited slip element is interposed between a floor and said cushion substrate for limiting slippage. An engagement arrangement couples the limited slip element to the cushion cover. In a highly advantageous embodiment of the invention, the limited slip element has a rigid panel dimensioned to be smaller than the cushion substrate. The rigid panel has first and second principal sides. A non-slip material is affixed to second principal side of the rigid panel. Preferably, the engagement arrangement has a hook and loop arrangement that is arranged to couple the first principal side of the rigid panel to an underside of the cushion substrate.

In accordance with a further apparatus aspect of the invention, there is provided a kneeling cushion for a human user, the kneeling cushion having a cushion substrate formed of a resilient batting material having a first resilience characteristic. First and second spaced-apart knee-receiving elements are provided formed of a knee pad material having a second resilience characteristic. The second resilience characteristic is firmer than the first resilience characteristic. Additionally, the first and second spaced-apart knee-receiving elements each having a lateral portion for supporting laterally the knees the human user. A cushion cover is arranged to overlie the cushion substrate and the first and second spaced-apart knee-receiving elements. Additionally, a limited slip element is coupled to the cushion cover in the vicinity of the underside of the cushion substrate.

In a further embodiment, the prayer pillow of the present invention has a pillow case that is filled or stuffed with a filling material that may be cotton or polyester batting, or in some embodiments, a resilient foam, such as polyurethane foam. It is contemplated, however, that the filling may be particulate in nature, such as foam or polymeric particles. The filling material provides shape to the pillow, further cushioning for the knees of the user, and a supports structure into which the knee pads of the present invention are placed.

The pillow case, which may, in some embodiments of the invention, define the shape or configuration of the pillow itself, may be of any shape, such as rectangular or square, and may be formed by simply sewing a top sheet, or panel, of fabric to a bottom sheet of fabric having the desired configuration; or it may be gusseted as is known in the art so that it has dimensioned side portions around the periphery of the pillow.

In preferred embodiments of the invention, the pillow case is removable so as to be washable or replaceable in case of damage, or simply the desire to have a variation in the design or color. The pillow case may be provided with a pleasant design and/or verses of Biblical scripture or encouraging comments. Of course, the pillow case may also incorporate decorative trim, such as rope edging, tassels, or fringe.

In some embodiments, the bottom panel of the pillow case comprises a slip-resistant material, such as a rubberized material, or a material on which areas of slip-resistant material is screen-printed. Of course, a fabric that has a nap, such as corduroy or velvet, would resist slippage on carpet.

It is important that the pillow case be dimensioned properly so that it is loose enough to accommodate placement of the user's knees within the knee pads without being unduly stressed so as to cause damage to the seams, or the material of the pillow case itself. Of course, the pillow case can be fabricated of a flexible, or elastic, material, such as polyester or spandex. In some embodiments, a flexible or elastic material can be incorporated into the design so that it covers the vicinity of the pillow where a user would place his knees into the knee pad portions.

A pair of knee pads, spaced apart and adapted to receive and support the knees of a user in a kneeling position, are placed within the filling material of the pillow. Knee pads of the type that are known and used in the art, such as knee pads for athletic purposes, gardening, or construction work, may be adapted for use in the pillow of the present invention. In general, knee pads have cushioning material that surrounds the interior of a generally rigid protective housing, such as a molded shell of plastic, leather, or preferably, firm, cotton or fiber padding that has a generally convex outside shape and a concave interior shape, forming a cup, that is adapted to receive a bended knee. In use, the knee pads cushion the patella of the knee at the bottom and provide support along the sides to assist the user to retain a comfortable kneeling position for an extended period of time. Therefore, the knee pads may have additional cushioning material, such as foam, rubber, or a gel, in the vicinity where the patella contacts the knee pad cup.

In the case of polyester batting as a filling material, the knee pads are placed in depressions in the upper surface of the pillow filling material. The knee pads may be affixed to the filling material by two-way tape, glue, or stitching, for example. In some embodiments, as will be described more completely hereinbelow, the knee pads may also be anchored to the pillow by elastic or non-elastic tethers.

In embodiments where the filling material is a resilient foam, the knee pads may be placed in depressions formed in the upper surface of the foam pillow form. The depressions, preferably do not extend through the entire foam pillow form, and are spaced apart and adapted to receive the two knee pads. The knee pads may be affixed to the filling material by two-sided tape or glue.

In other preferred embodiments, the pillow further includes a non-slip board. In this case, a lightweight planar board, that may be dimensioned similar to the pillow, is removably attached to the bottom surface of the pillow case, illustratively by Velcro brand hook and loop fasteners. The board is covered, at least on its bottom, floor-contacting surface, with a non-slip material, such as a rubberized material. Of course, the board itself could comprise the lower floor-contacting surface of a padded cushion that contains the knee pads within the cushion- or pillow filling material. In this case, the knee pads may be anchored to the board by elastic or non-elastic tethers, either alone, or in conjunction with other fastening means, such as glue.

BRIEF DESCRIPTION OF THE DRAWING

Comprehension of the invention is facilitated by reading the following detailed description, in conjunction with the annexed drawing, in which.

DETAILED DESCRIPTION

Figure 1:
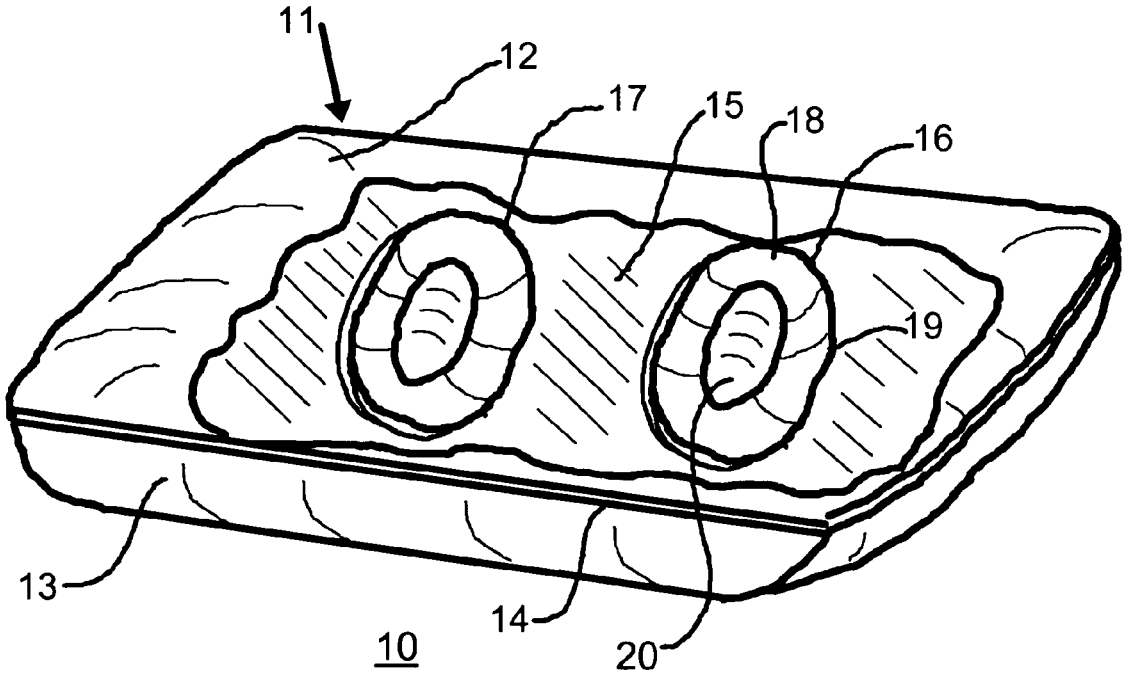
FIG. 1 is a partially cut-away perspective view of a prayer pillow in accordance with the present invention.

FIG. 1 is a partially cut-away perspective view of a prayer pillow 10 in accordance with the present invention. Prayer pillow 10 comprises an exterior pillow case 11, or cover. In this figure, pillow case 11 is shown to have a top panel 12, which is the knee-contacting surface of the pillow case. Pillow case 11 is shown to be partially removed by cut-away to permit viewing of the interior of pillow 10. In this embodiment, top panel 12 is stitched to a bottom panel 13, or the floor-contacting surface of the pillow case, through decorative piping 14. The interior of the pillow is filled, or stuffed, with a filling material 15 shown schematically) that may consist of a cotton or polyester batting material. On the exterior, prayer pillow 10 appears to be a normal decorative pillow or cushion. For example, art work or text (not shown) may be printed on the top surface of top panel 12. A zipper, not shown, for example, may be included in a seam between top panel 12 and bottom panel 13 to permit the pillow case or cover to be removed for laundering.

Spaced apart knee pad portions 16 and 17 are located in depressions in filling material 15. Referring specifically to knee pad portion 16, a firm cushioning material 19 forms the interior surface of a concave or cup-like opening 18 that is adapted to receive a bended knee (not shown). Cushioning material 19 extends along the upward flanges of concave opening 18 to support the sides of the knee of the user. In some embodiments, additional padding, such as a foam or gel insert 20 is placed in the bottom of concave opening 18 where it would contact the patella (not shown) of the user's knee. Knee pad portions 16 and 17 may be affixed to filling material 15 by glue (not shown) or two-sided tape (not shown). In some embodiments of the invention, however, the knee pad portions are not affixed by glue and therefore are permitted a measure of lateral movement. Such lateral movement is produced, in some embodiments, by inward or outward forces applied by the knees of the user whereby the spacing between the knee pad portions is adjusted to the comfort of the user.

Figure 2:
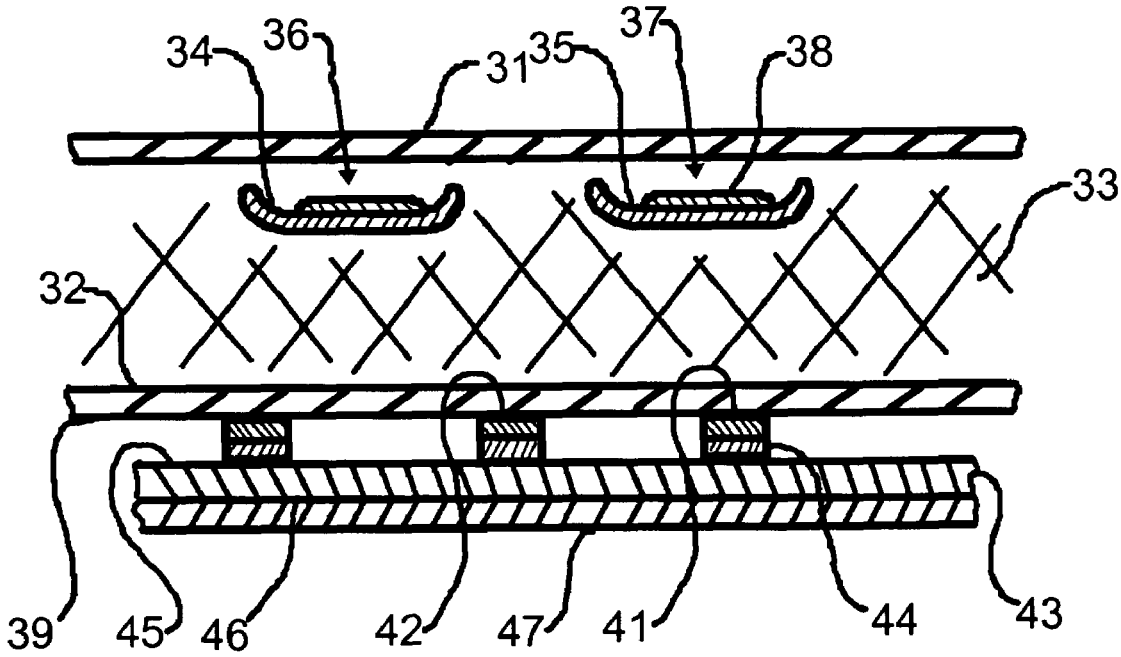
FIG. 2 is a partially schematic cross-sectional view of a second embodiment of a prayer pillow in accordance with the invention.

FIG. 2 is a partially schematic cross-sectional view of a second embodiment of a prayer pillow in accordance with the invention. Elements of structure that have previously been discussed are similarly designated. In this embodiment, the pillow case comprises a top panel 31 and a bottom panel 32. The interior of a pillow defined by the top panel 31 and bottom panel 32 contains filling material 33, which may be batting or foam. In this case, knee pads 34 and 35 form cup-like openings 36 and 37. Referring to knee pad 34, padding 38, that may be of any known type or configuration, forms the interior surface of cup-like opening 36.

A bottom surface 39 of bottom panel 32 of the pillow case, in this particular embodiment, is provided with areas 41, 42, for example, that comprises one half of a Velcro® hook and loop fastener set. A rigid panel 43, such as a lightweight fiberboard, is provided with the other half of the Velcro hook and loop fastener set 44 on a top, pillow-contacting surface 45. Rigid panel 43 may or may not be covered on both top and bottom sides with a fabric. In a preferred embodiment, bottom, floor-contacting surface 46 of rigid panel 43 is provided with means to avoid slippage when the prayer pillow is placed on the floor. Thus, the bottom, floor-contacting surface may include a rubberized material 47.

While the prayer pillow of the present invention has been described in terms of one user, it is to be understood that the pillow can be adapted for a plurality of users, such as a couple desiring to pray together in face-to-face relation, or multiple worshipers in kneeling benches (side-by-side) in front of church pews.

Although the invention has been described in terms of specific embodiments and applications, persons skilled in the art may, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof.

What is claimed is:

1. A kneeling cushion for a human user, the kneeling cushion comprising:

a cushion substrate formed of a resilient cushion material having a first resilience characteristic;

first and second spaced-apart knee-receiving elements formed of a knee pad material having a second resilience characteristic, the second resilience characteristic being firmer than the first resilience characteristic; and a cushion cover arranged to overlie said cushion substrate and said first and second spaced-apart knee-receiving elements.

2. The kneeling cushion of claim 1, wherein the resilient cushion material is a filling material.

3. The kneeling cushion of claim 2, wherein the filling material is a cotton batting.

4. The kneeling cushion of claim 2, wherein the filling material is a polyester batting.

5. The kneeling cushion of claim 2, wherein the filling material is configured to have spaced-apart depressions for accommodating said first and second spaced-apart knee-receiving elements.

6. The kneeling cushion of claim 2, wherein said first and second spaced-apart knee-receiving elements are disposed at a distance from one another that is adjustable in response to forces applied by the human user.

7. The kneeling cushion of claim 1, wherein said first and second spaced-apart knee-receiving elements are configured to have respective cup-like openings for accommodating the respective bended knees of the human user.

8. The kneeling cushion of claim 7, wherein the cup-like openings each have an associated upward extending member for providing lateral support to the respective bended knees of the human user.

9. The kneeling cushion of claim 7, wherein the cup-like openings each have an associated foam insert therein.

10. The kneeling cushion of claim 7, wherein the cup-like openings each have an associated gel insert therein.

11. The kneeling cushion of claim 1, wherein there is further provided:

a limited slip element interposed between a floor and said cushion substrate for limiting slippage; and an engagement arrangement for coupling the limited slip element to said cushion cover.

12. The kneeling cushion of claim 11, wherein said limited slip element comprises:

a rigid panel dimensioned to be smaller than said cushion substrate, said rigid panel having first and second principal sides; and a non-slip material affixed to second principal side of said rigid panel.

13. The kneeling cushion of claim 12, wherein said engagement arrangement comprises a hook and loop arrangement.

14. The kneeling cushion of claim 13, wherein said hook and loop arrangement is arranged to couple said first principal side of said rigid panel to an underside of said cushion substrate.

15. A kneeling cushion for a human user, the kneeling cushion comprising:

a cushion substrate formed of a resilient batting material having a first resilience characteristic;

first and second spaced-apart knee-receiving elements formed of a knee pad material having a second resilience characteristic, the second resilience characteristic being firmer than the first resilience characteristic, said first and second spaced-apart knee-receiving elements each having a lateral portion for supporting laterally the knees the human user;

a cushion cover arranged to overlie said cushion substrate and said first and second spaced-apart knee-receiving elements; and a limited slip element coupled to said cushion cover in the vicinity of the underside of said cushion substrate.

* * * * *